US007458152B2

(12) United States Patent
Sato

(10) Patent No.: US 7,458,152 B2
(45) Date of Patent: Dec. 2, 2008

(54) METHOD OF MANUFACTURING AN ORBITING SCROLL IN A SCROLL FLUID MACHINE

(75) Inventor: Toru Sato, Yokohama (JP)

(73) Assignee: Anest Iwata Corporation, Kanagawa (JP)

( * ) Notice: Subject to any disclaimer, the term of this patent is extended or adjusted under 35 U.S.C. 154(b) by 626 days.

(21) Appl. No.: 11/140,873

(22) Filed: May 31, 2005

(65) Prior Publication Data

US 2005/0262689 A1 Dec. 1, 2005

(30) Foreign Application Priority Data

May 31, 2004 (JP) ..... 2004-160527

(51) Int. Cl.

| | |
|---|---|
| ***B21D 39/03*** | (2006.01) |
| ***B23P 15/00*** | (2006.01) |
| ***B23P 25/00*** | (2006.01) |
| ***B23Q 3/00*** | (2006.01) |
| ***F01C 1/02*** | (2006.01) |
| ***F01C 1/063*** | (2006.01) |
| ***F01C 21/04*** | (2006.01) |
| ***F03C 2/00*** | (2006.01) |

(52) U.S. Cl. ..... 29/888.022; 29/458; 29/464; 29/468; 418/55.1; 418/55.2; 418/55.3; 418/55.5; 418/85

(58) Field of Classification Search ..... 29/428, 29/458, 464, 466, 468, 888.02, 888.022; 418/55.1–55.2, 55.3, 55.5, 85

See application file for complete search history.

(56) References Cited

U.S. PATENT DOCUMENTS

| | | | | |
|---|---|---|---|---|
| 4,911,620 | A * | 3/1990 | Richardson et al. | 418/55.5 |
| 5,088,906 | A * | 2/1992 | Richardson, Jr. | 418/55.2 |
| 5,366,359 | A * | 11/1994 | Bookbinder et al. | 418/55.5 |
| 2002/0006320 | A1 * | 1/2002 | Kupper et al. | 411/383 |
| 2002/0098100 | A1 * | 7/2002 | Mori et al. | 418/55.2 |
| 2003/0053922 | A1 * | 3/2003 | Satoh et al. | 418/55.1 |

* cited by examiner

*Primary Examiner*—David P Bryant
*Assistant Examiner*—Alexander P Taousakis
(74) *Attorney, Agent, or Firm*—Skinner and Associates

(57) ABSTRACT

In a scroll fluid machine, an orbiting scroll is eccentrically revolved with respect to a fixed scroll by a driving shaft to compress a gas toward a center. To manufacture the orbiting scroll, a reference bore is formed at the center of orbiting scroll material, and a reference bore is formed at the center of bearing plate material. A dowel pin is inserted in the two reference bores. The orbiting scroll material is combined with the bearing plate material with a bolt and an adhesive.

7 Claims, 7 Drawing Sheets

PRIOR ART

METHOD OF MANUFACTURING AN ORBITING SCROLL IN A SCROLL FLUID MACHINE

BACKGROUND OF THE INVENTION

The present invention relates to a method of manufacturing an orbiting scroll in a scroll fluid machine such as a scroll compressor, a scroll vacuum pump, a scroll expander or a scroll blower.

FIG. 6 shows a scroll fluid machine in which a fixed wrap 12 of a fixed scroll 11 engages with an orbiting wrap 16 of an orbiting scroll 15 rotatably connected to an eccentric axial portion 14 of a driving shaft 13. The orbiting scroll 15 is eccentrically revolved with respect to the fixed scroll 11 by the eccentric axial portion 14, thereby compressing a gas sucked through an air intake bore 17 as it moves toward a center. The rear surfaces of the scrolls 11, 15 have a plurality of cooling fins 18, 19 to release heat generated during operation.

The ends of the cooling fins 18 of the fixed scroll 11 are covered with a housing cover 20 to form a gas cooling path, while the ends of the cooling fins 19 of the orbiting scroll 15 are contacted with a bearing plate 23 which is rotatably mounted around the eccentric axial portion 14 via a bearing 21 and a bearing sleeve 22 to form a gas cooling path.

It is known that a predetermined compression or decompression is achieved by revolving the bearing plate 23 and the orbiting scroll 15 eccentrically by the eccentric axial portion 14.

To manufacture an orbiting scroll as described above, after working an orbiting scroll material and a bearing plate material separately, they are combined and the surfaces are treated.

As shown in a flow chart of FIG. 7, an orbiting scroll is manufactured by the steps "S" below:

S1: providing an orbiting scroll material;

S2: forming a plurality of cooling fins on the orbiting scroll material;

S3: providing a bearing plate material;

S4: forming a bearing bore in a bearing sleeve of the bearing plate material;

S5: aligning outer shapes of both the materials to combine them with a bolt and an adhesive;

S6: working an orbiting scroll with reference to the bearing bore;

S7: applying surface treatment on the combined materials; and

S8: obtaining a complete orbiting scroll.

However, such a method is disadvantageous in terms of productivity and precision of a product.

(a) Because an orbiting wrap is cut based on a bearing bore of the bearing plate material combined with the orbiting scroll material, positioning accuracy of the orbiting wrap depends on a position and precision of the bearing bore. As the position and precision of the bearing bore are not necessarily high order of accuracy, it is impossible to obtain products with high precision in micron order.

(b) Because the orbiting wrap is worked after combining the orbiting scroll material and the bearing plate material, handling and processing are difficult and workability is low.

(c) Surface treatment is applied after combining the orbiting scroll material having the cooling fins formed thereon and the bearing plate material having the bearing bore formed therein. Such surface treatment is not generally required for the bearing plate material, and unnecessary work and cost are involved.

(d) To cut the orbiting wrap after combining both materials, if one of the materials is found to be bad in quality or defective, it is difficult to take out only the material which is plastically deformed or has accumulated stress during the steps. Therefore, both the materials must be dumped together, which is uneconomical.

SUMMARY OF THE INVENTION

In view of the foregoing disadvantages in the prior art, it is an object of the present invention to provide a method of manufacturing an orbiting scroll in a scroll fluid machine in which the orbiting scroll is combined with a bearing plate in high precision at low cost.

DETAILED DESCRIPTION OF PREFERRED EMBODIMENTS

An embodiment of the present invention will be described with reference to FIGS. 1 to 5.

Figure 1:
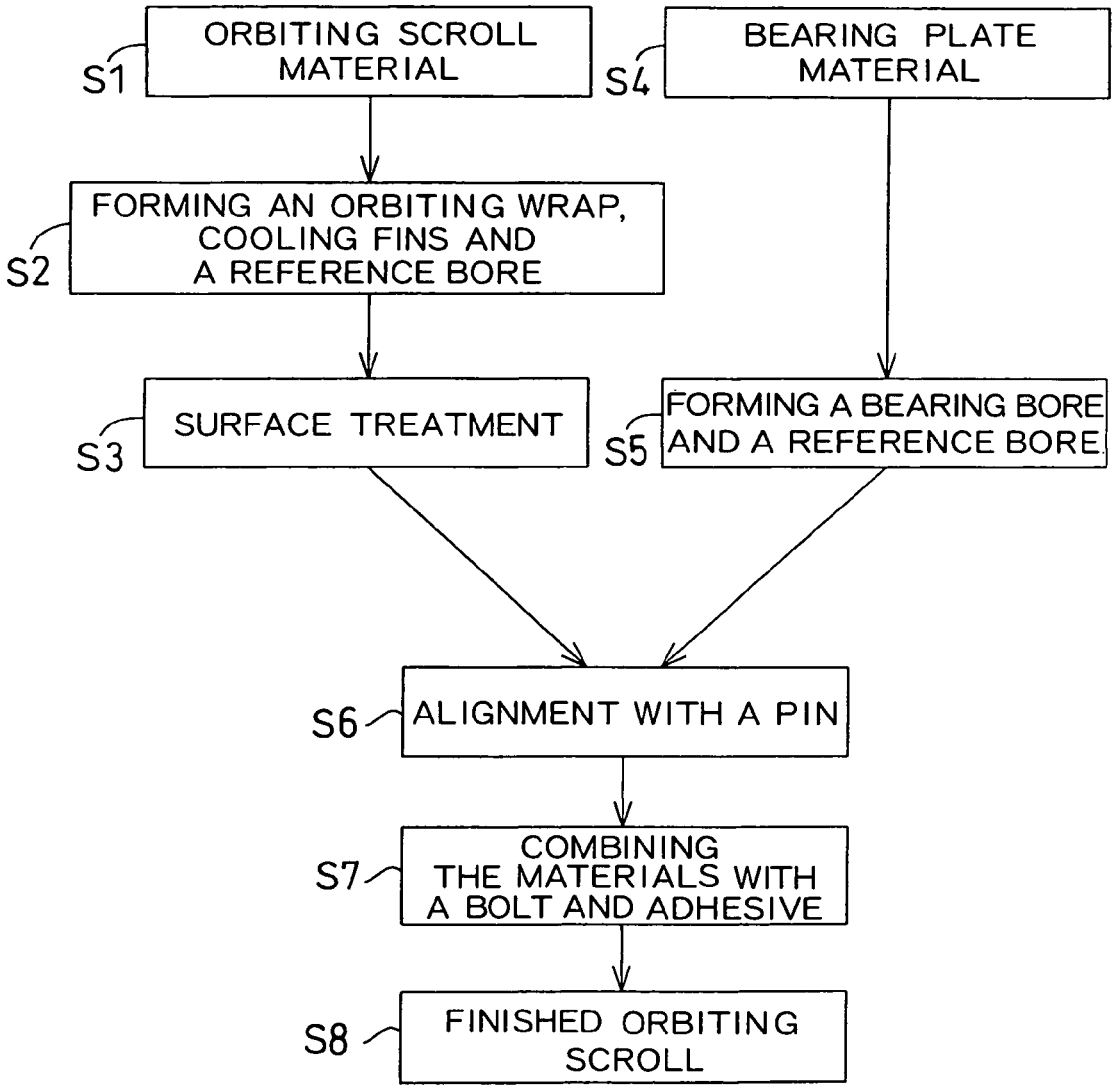
FIG. 1 is a flow chart showing a method of manufacturing an orbiting scroll in a scroll fluid machine according to the present invention.
Figure 2:
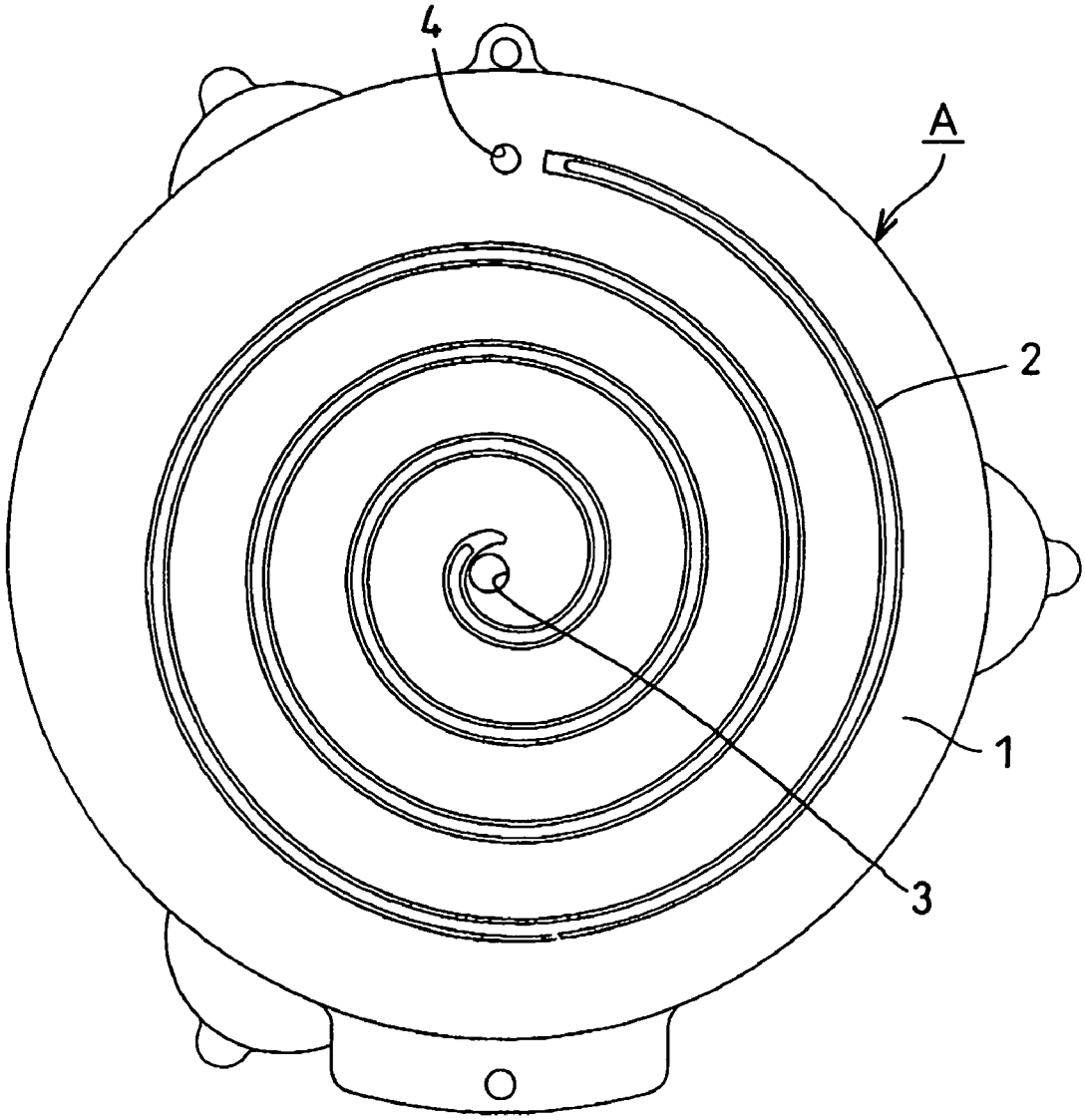
FIG. 2 is a front view of an orbiting scroll material used in the present invention.
Figure 7:
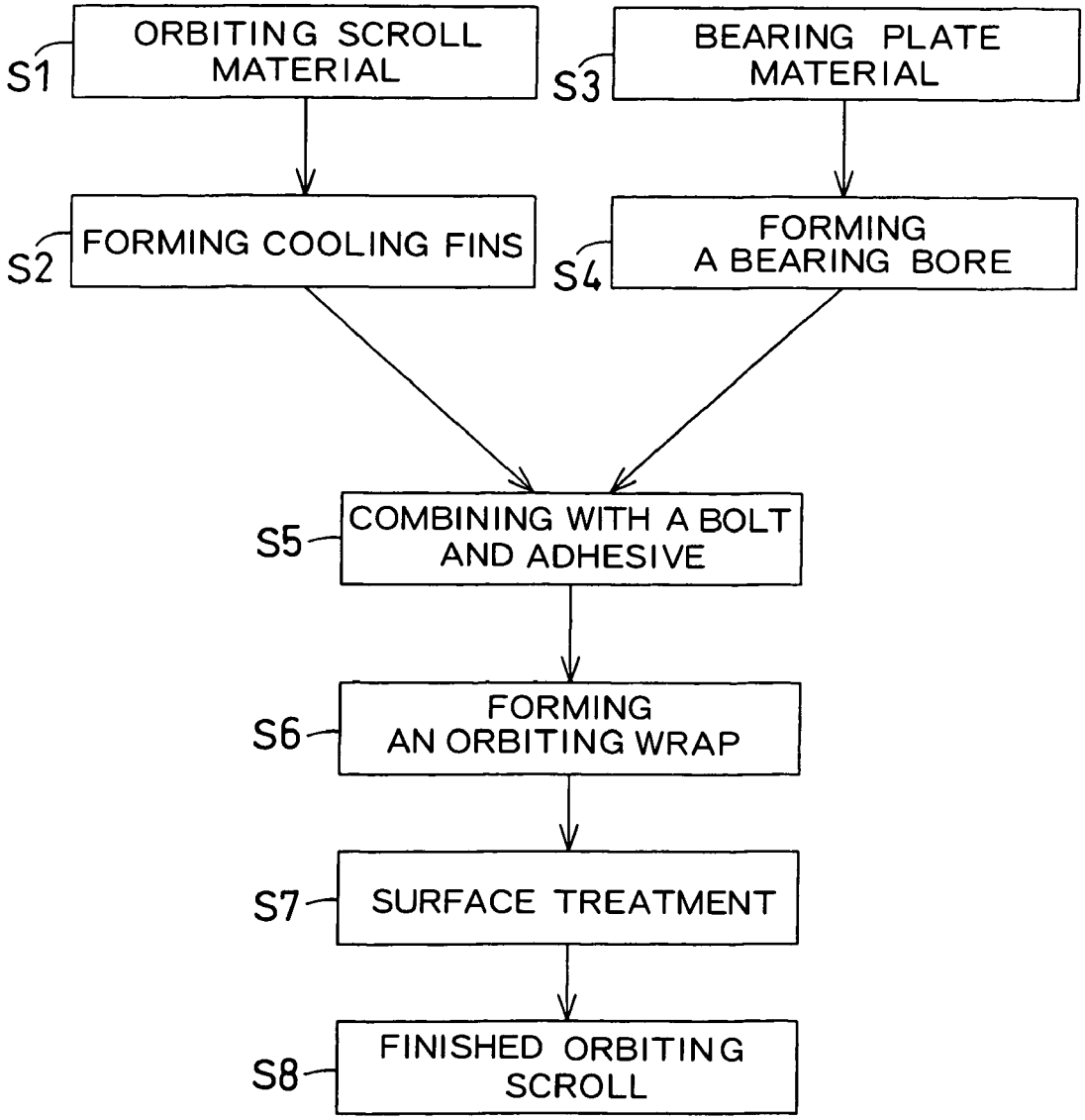
FIG. 7 is a flow chart of a known method of manufacturing an orbiting scroll.

The following steps "S" are carried out as shown in FIG. 1 which is compared with the conventional method in FIG. 7:

S1: providing an orbiting scroll material;

S2: forming a plurality of cooling fins and an orbiting wrap on the orbiting scroll material and perforating axial reference bores at suitable positions;

S3: applying surface treatment on the orbiting scroll material;

S4: providing a bearing plate material;

S5: perforating a bearing bore and axial reference bores corresponding to the reference bores of the orbiting scroll material in the bearing plate material;

S6: aligning the reference bores of both the materials and inserting positioning pins parallel to each other therein;

S7: combining the orbiting scroll material with the bearing plate material with a bolt and an adhesive; and S8: obtaining a complete orbiting scroll.

A reference bore 3 extending axially and having circular cross section is formed with high precision at a center of a base circle or at the inner end of an orbiting wrap 2 formed on an orbiting end plate 1 of orbiting scroll material "A".

A reference bore 4 extending axially and having circular cross section is formed with high precision at a position radially far from the center of the base circle at the outer end of the orbiting wrap 2.

Figure 3:
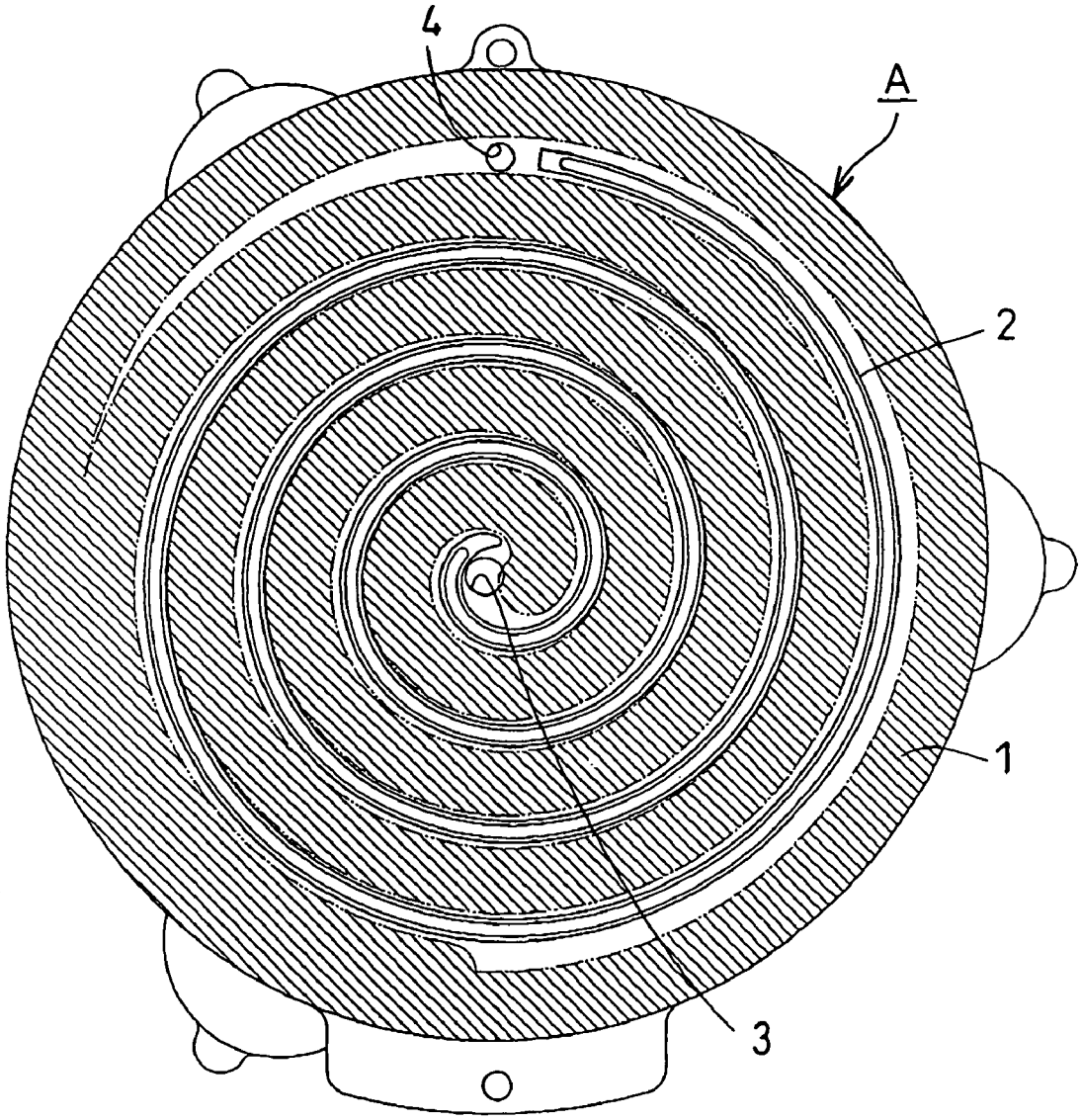
FIG. 3 is a front view showing a relationship between reference bores in FIG. 2 and an area in which the end of a fixed wrap of a fixed scroll slides.

As illustrated in FIG. 3, both the reference bores 3,4 are formed outside an area (shown with hatching) in which a tip or dust seal on the end of the fixed wrap of the fixed scroll is in sliding contact with the orbiting end plate 1.

Figure 4:
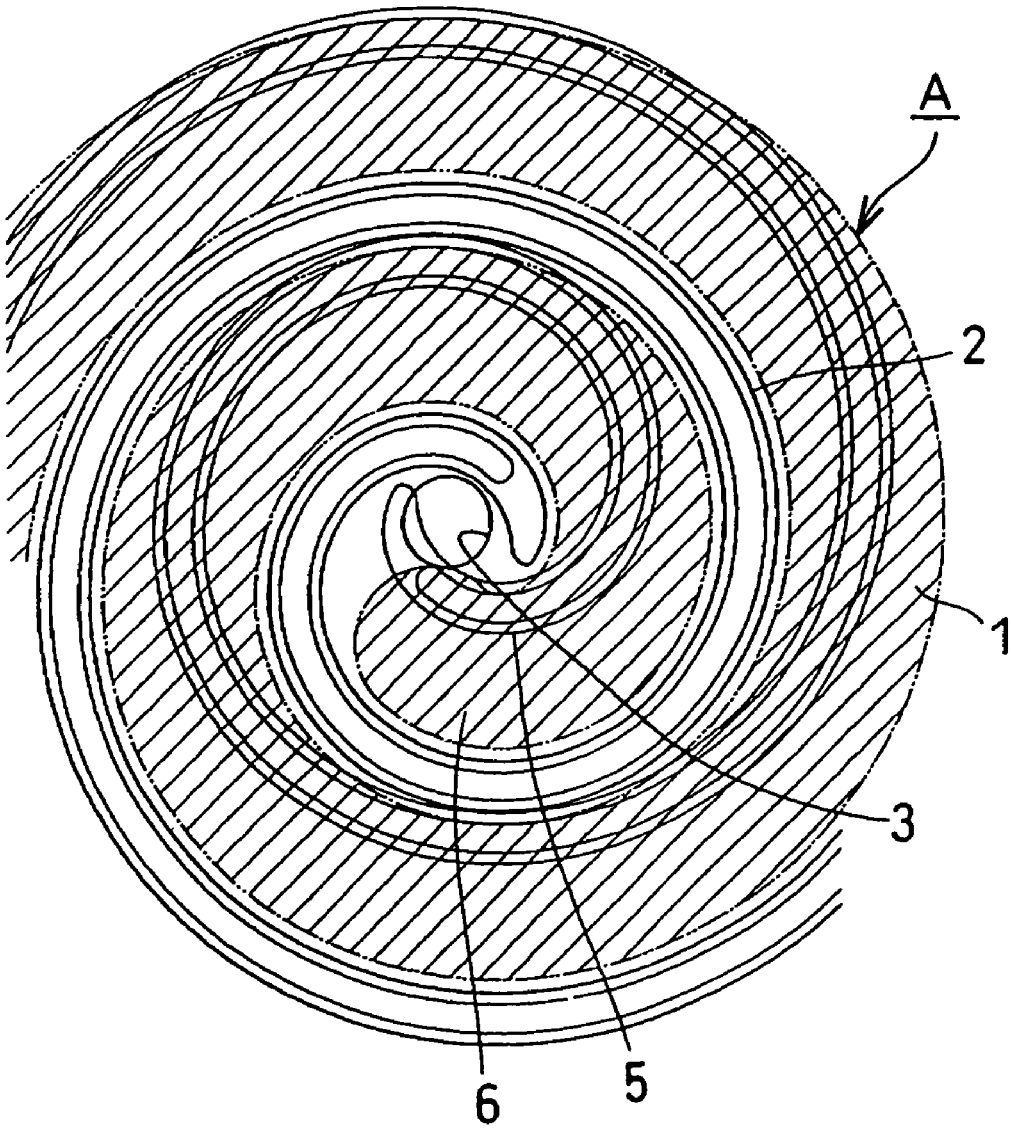
FIG. 4 is a front view showing a relationship between a reference bore positioned in a center and an area slid by a fixed wrap of a fixed scroll in FIG. 2.

FIG. 4 is an enlarged view of the reference bore 3 formed at the center of the base circle or at the inner end of the orbiting wrap 2. The reference bore 3 is not within a sliding surface 6 which contacts the end of the fixed wrap 5.

Figure 5:
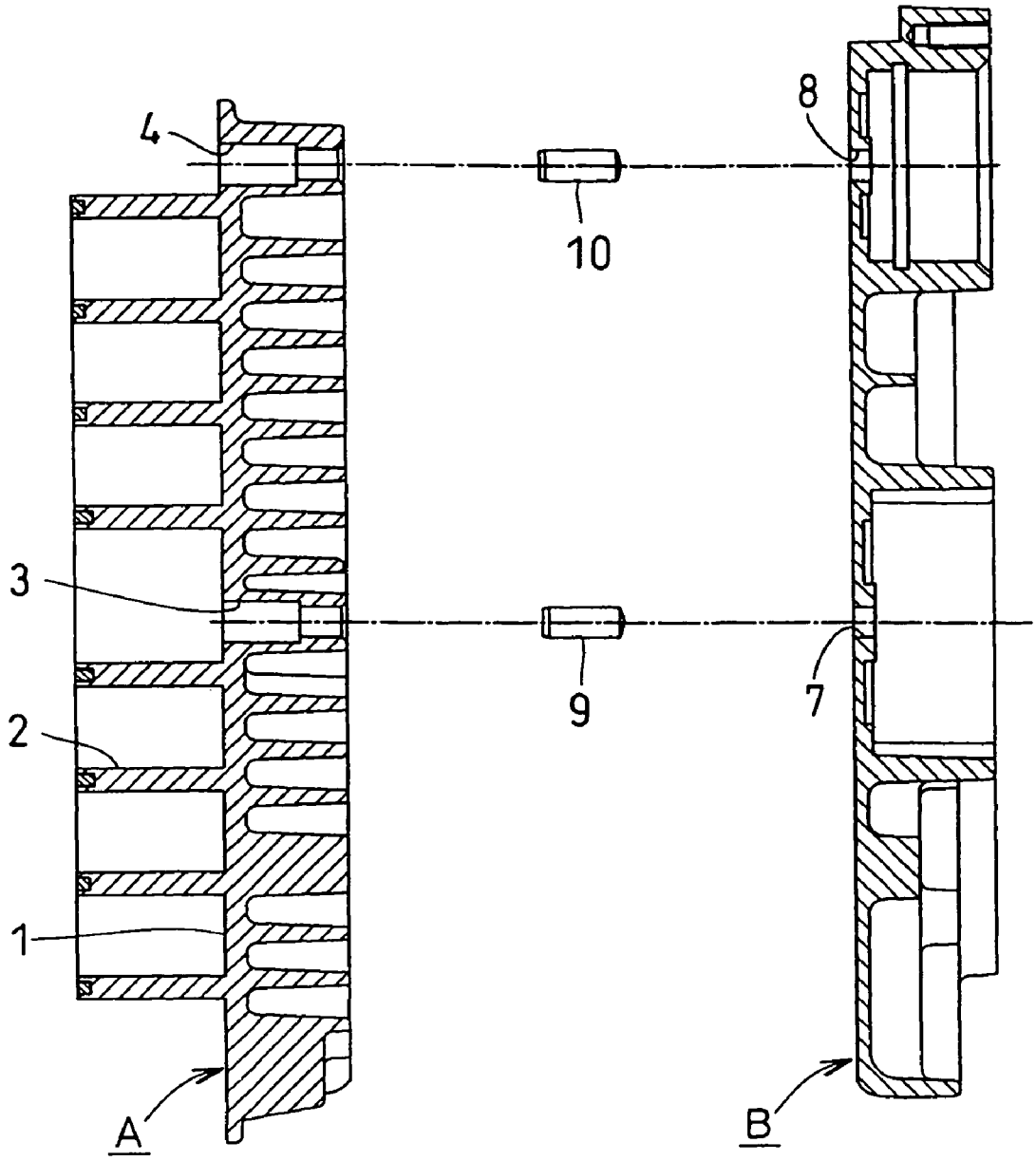
FIG. 5 is a vertical sectional side view of an orbiting scroll material and a bearing plate material.
Figure 6:
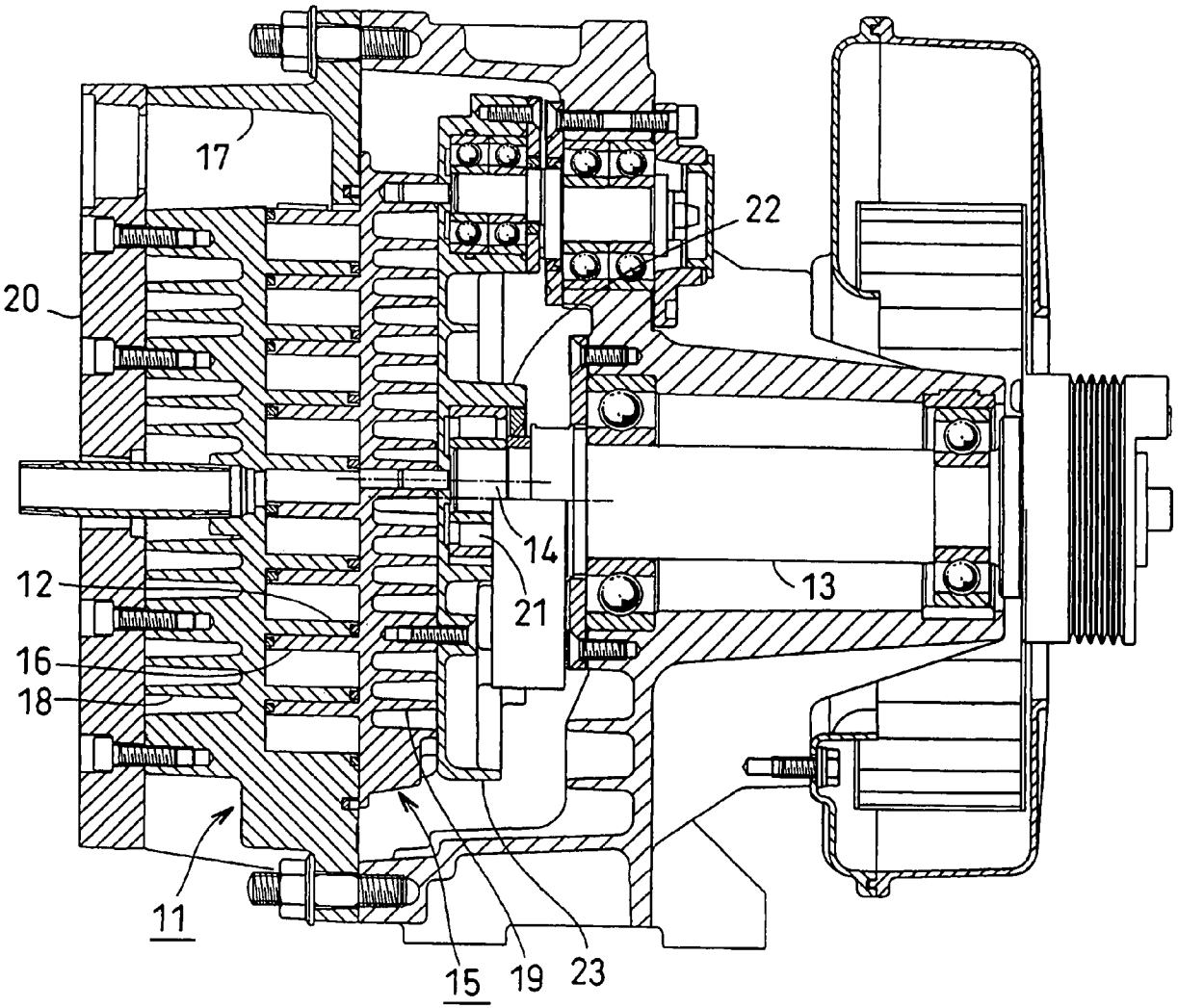
FIG. 6 is a vertical sectional side view of a scroll fluid machine in which the present invention is carried out.

FIG. 5 is a vertical sectional side view of the orbiting scroll material "A" and the bearing plate material "B", in which axial reference bores 7, 8 are perforated respectively in portions of the bearing plate material "B" corresponding to the reference bores 3, 4 of the orbiting scroll material "A". Dowel pins 9, 10 in parallel are inserted into the reference bores in alignment.

If the reference bore and the dowel pin have non-circular cross section, a single dowel pin may be used with a single bore for each of orbiting material and bearing plate material.

The foregoing merely relates to an embodiment of the invention. Various changes and modifications may be made by a person skilled in the art without departing from the scope of claims wherein:

What is claimed is:

1. A method of manufacturing an orbiting scroll in a scroll fluid machine, the method comprising the steps of:

providing an orbiting scroll material;

forming a first inner reference bore near a center and a first outer reference bore near an outer circumference axially in the orbiting scroll material at high precision on size and location;

forming an orbiting wrap and a plurality of cooling fins on the orbiting scroll material;

applying surface treatment on the orbiting scroll material;

providing a bearing plate material;

forming a second inner reference bore near a center and a second outer reference bore near an outer circumference at high precision axially in the bearing plate material at positions corresponding to the first inner reference bore and the first outer reference bore of the orbiting scroll material;

aligning the first inner reference bore with the second inner reference bore and first outer reference bores with the second outer reference bore without surface treatment to the bearing plate material; and inserting a first dowel pin into the first and second inner reference and a second dowel pin into the second inner reference bore and the second outer reference bores to combine the orbiting plate material with the bearing plate material to obtain the finished orbiting scroll.

2. A method as claim in claim 1 wherein each of the first reference bore, the second reference bore and the pin has non-circular cross section.

3. A method as claimed in claim 1 wherein there is a plurality of first inner and outer reference bores, a plurality of second inner and outer reference bores and a plurality of pins, each having a circular cross section.

4. A method as claimed in claim 1 wherein the first and second reference bores comprise through-bores.

5. A method as claimed in claim 1 wherein the first and second inner reference bores are formed at the center of the orbiting scroll material and the bearing plate material respectively.

6. A method as claimed in claim 1 wherein the orbiting scroll material is combined with the bearing plate material with a bolt and an adhesive.

7. A method as claimed in claim 1 wherein all the references bores are parallel with an axis of the orbiting scroll.

* * * * *